US008679199B2

(12) United States Patent
Gruetter et al.

(10) Patent No.: US 8,679,199 B2
(45) Date of Patent: Mar. 25, 2014

(54) FORMULATIONS OF FLUORESCENT WHITENING AGENTS IN DISPERSED FORM

(75) Inventors: Serge Gruetter, Courgenay (CH); Jean-Jacques Donze, Blodelsheim (FR); Serge Schroeder, Rosenau (FR); Andrea Frey, Rheinfelden (DE)

(73) Assignee: Hunstman International LLC, The Woodlands, TX (US)

( * ) Notice: Subject to any disclaimer, the term of this patent is extended or adjusted under 35 U.S.C. 154(b) by 0 days.

(21) Appl. No.: 13/996,192

(22) PCT Filed: Jan. 4, 2012

(86) PCT No.: PCT/EP2012/050098

§ 371 (c)(1), (2), (4) Date: Jun. 20, 2013

(87) PCT Pub. No.: WO2012/098015

PCT Pub. Date: Jul. 26, 2012

(65) Prior Publication Data

US 2013/0283547 A1 Oct. 31, 2013

(30) Foreign Application Priority Data

Jan. 20, 2011 (EP) ..... 11151511

(51) Int. Cl.
*D06L 3/12* (2006.01)

(52) U.S. Cl.
USPC ..... 8/405; 8/648; 8/107

(58) Field of Classification Search
USPC ..... 8/648, 107
See application file for complete search history.

(56) References Cited

U.S. PATENT DOCUMENTS

| | | | | |
|---|---|---|---|---|
| 4,713,081 | A | 12/1987 | Becker | |
| 5,051,111 | A | 9/1991 | Anceschi et al. | |
| 5,053,055 | A * | 10/1991 | Fringeli et al. | 8/648 |
| 2005/0008593 | A1 | 1/2005 | Plos et al. | |
| 2005/0235429 | A1 | 10/2005 | Weber et al. | |

FOREIGN PATENT DOCUMENTS

| | | |
|---|---|---|
| GB | 1298236 | 11/1972 |

OTHER PUBLICATIONS

STICC Search Report dated Sep. 30, 2013.*

* cited by examiner

*Primary Examiner* — Eisa Elhilo

(57) ABSTRACT

The present invention relates to an aqueous dispersion containing (a) a fluorescent whitening agent, (b) a dispersing agent, (c) a β-1,3-glucan and, optionally, (d) a vat dye and the use of the aqueous dispersions for whitening synthetic fibers, in particular polyester and polyacrylonitrile.

16 Claims, No Drawings

FORMULATIONS OF FLUORESCENT WHITENING AGENTS IN DISPERSED FORM

CROSS REFERENCE TO RELATED APPLICATIONS

This application is the National Phase of International Application PCT/EP2012/050098 filed Jan. 4, 2012 which designated the U.S. and which claims priority to European (EP) Pat. App. No. 11151511.0 filed Jan. 20, 2011. The noted applications are incorporated herein by reference.

The present invention relates to formulations of fluorescent whitening agents (FWAs) in dispersed form and their use for brightening textile materials.

Fluorescent whitening agents (FWAs) provide outstanding whitening effects on synthetic textile fibres, but the aqueous dispersions of these agents are often not sufficiently storage-stable, i.e. storage at room temperature over months leads to precipitation and turbidity of the dispersion.

It has now, surprisingly, been found that stable aqueous dispersions of stilbene brighteners can be obtained by addition of a small amount of β-1,3-glucane. The addition of the stabiliser facilitates an effective control of pH and does not advertisely affect the brightening activity of the agent and the properties of the treated fibres.

The invention relates to an aqueous dispersion containing (a) a fluorescent whitening agent, (b) a dispersing agent and (c) a β-1,3-glucane.

Basically, any FWA known for this purpose can be applied in the aqueous dispersions according to the invention. Preferably, dicyano-1,4-bis-styrylbenzenes and bisbenzoxazoles are used.

The invention therefore relates to an aqueous dispersion as described above containing as fluorescent whitening agent a compound of formula (1)

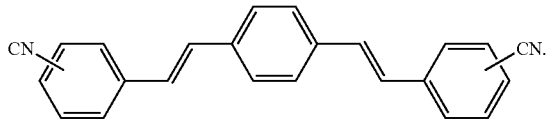

More preferably, the aqueous dispersions according to the invention contain as fluorescent whitening agent a compound of formula (1a)

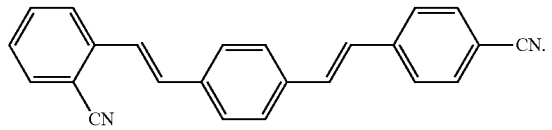

In a further preferred embodiment the aqueous dispersion according to the invention contains as fluorescent whitening agent a compound of formula (2)

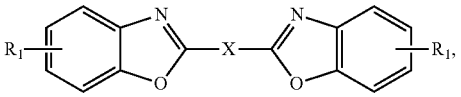

wherein $R_1$ denotes hydrogen, $C_1$-$C_6$alkyl, $C_6$-$C_{14}$aryl or $C_7$-$C_{24}$aralkyl and X is a bivalent radical of formula (3), (4) or (5)

(3)

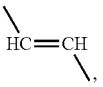

(4)

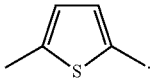

(5)

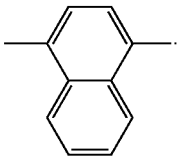

$C_1$-$C_6$alkyl as $R_1$ includes for example methyl, ethyl, propyl, isopropyl, n-butyl, isobutyl, sec-butyl, tert-butyl, amyl, tert-amyl (1,1-dimethylpropyl) n-pentyl, neopentyl, and n-hexyl.

Examples for $C_6$-$C_{14}$aryl are phenyl, tolyl, mesityl, isityl, xylyl, naphthyl, anthryl and phenanthryl.

$C_7$-$C_{24}$aralkyl as $R_1$ includes for example benzyl, 2-phenylethyl, diphenylmethyl, naphthylmethyl and 2-naphthylethyl.

Particularly preferred FWAs of formula (2) are the compounds of formula (2a) and (2b)

(2a)

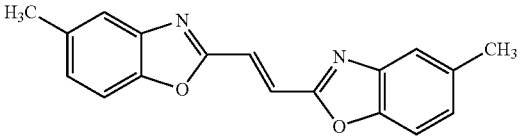

(2b)

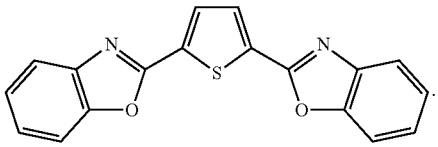

Dispersing agents suitable for the dispersions according to the present invention are preferably non-ionic surfactants.

Examples for non-ionionic dispersants are ethylene oxide adducts with fatty alcohols, higher fatty acids, alkyl phenols, sorbitol esters, di- and tristyrylphenol; copolymers of ethylene oxide and propylene oxide or ethylenediamine ethylene oxide/propylene oxide adducts.

Purposively, the aqueous dispersion according to the invention additionally contains an organic solvent, for example ethylene glycol, propylene glycol, diethylene glycol, dipropylene glycol, polyethylene glycol or polypropylene glycol.

β-1,3-glucanes are polysaccarides produced by the action of certain microorganisms on glucose. Suitable glucanes that can be applied as thickening agents in water are disclosed, for example, in U.S. Pat. No. 3,301,848.

A preferred β-1,3-glucane is scleroglucan.

Fluorescent whitening agents are often used in the form of mixtures of two or more components, since such mixtures may exhibit a higher degree of whiteness than that of the sum of the individual components alone.

In a preferred embodiment the aqueous dispersions according to the invention contain as fluorescent whitening agent a mixture comprising 5-25% by weight, in particular 10-20% by weight, of a compound of formula (1) and 75-95% by weight, in particular 80-90% by weight, of at least one compound of formula (2), each percentage being based on the sum total of all fluorescent whitening agents.

Particularly preferred are aqueous dispersions as described above containing as fluorescent whitening agent a mixture comprising 2.5 to 25% by weight of a compound of formula (1a)

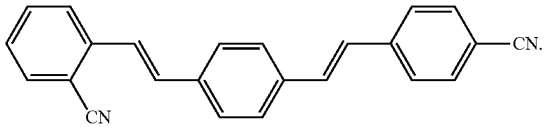

2.5 to 20% by weight of a compound of formula (2a)

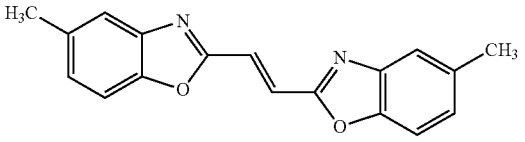

and 55 to 95% by weight of a compound of formula (2b)

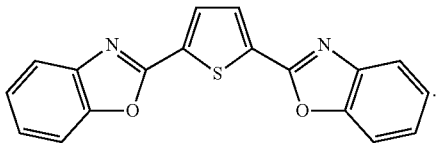

each percentage being based on the sum total of all whitening agents.

Furthermore, aqueous dispersions containing (a) 5-40% by weight, in particular 10-30% by weight, of a fluorescent whitening agent, (b) 0.5-15% by weight, in particular 1.0-10% by weight, of a dispersing agent and (c) 0.5-10% by weight, in particular 1.0-5.0% by weight, of a β-1,3-glucan, each percentage being based on the total weight of the dispersion are of particular interest.

The compounds of formulae (1) and (2) are well-known FWAs and commercially available or can be prepared according to well-known methods.

A further object of the present invention is a process for brightening textile materials by treatment with an aqueous dispersion as described above.

A still further object of the present invention is the use of an aqueous dispersion as described above for brightening synthetic fibres, in particular polyester fibres.

As is customary with mixtures of fluorescent whitening agents, the individual components can be processed to the commercial form by dispersing them in a liquid medium, preferably water. This can be done by dispersing the individual components and then combining the dispersions so obtained. However, it is also possible to mix the individual components together in substance and then to disperse them jointly. The dispersing operation is carried out in a conventional manner in ball mills, colloid mills, bead mills or the like.

Preferably, the FWA, in combination with together with water and a dispersing agent is wet-milled in the presence of glass beads. The resulting ground stock can be stored, divided into different portions and processed in a manner known per se.

The aqueous dispersions according to the present invention may further contain 0.1% to 60%, preferably 5 to 50% by weight, of auxiliaries.

Suitable auxiliaries include, for example, wetting agents, antifreezes, antifoams, thickeners/stabilizers and biocides.

Examples for thickeners/stabilizers are copolymers of N-vinylpyrrolidone with 3-vinylpropionic acid, polyvinylalcohols or non-ionic/anionic polysaccharides.

All types of formulation auxiliaries are described in McCutcheon's year books of Emulsifiers & Detergents and Functional Materials.

The aqueous dispersions of this invention and the compositions containing them are suitable for whitening textile materials made from synthetic fibres, in particular, those made from polyesters. However, these mixtures and compositions can also be used for whitening blends that contain polyesters.

The mixtures of this invention are applied by the methods normally employed for the application of fluorescent whitening agents, for example, by the exhaust dyeing process in dyeing machines or by pad-thermofixation. The treatment is conveniently effected in an aqueous medium in which the compounds are present in finely particulate form as suspensions, microdispersions or, as the case may be, solutions. If appropriate, dispersants, stabilisers, wetting agents and other assistants can be added during the treatment. The treatment is normally carried out in the temperature range from about 90° C. to 140° C., preferably 110 to 130° C. Where the mixtures are applied by the pad-thermofixation process, the thermofixing is preferably carried out at a temperature of between 170 and 200° C.

The aqueous dispersions according to the invention provide a blue shade without the addition of shading dyes.

Furthermore, the materials treated with the aqueous dispersions according to the invention exhibit a high lightfastness as well as a high whiteness level and excellent brilliancy.

It has surprisingly been found that β-1,3-glucanes are effective stabilizers not only for dispersions of FWAs but also for dispersions containing vat dyes and FWAs, which are suitable for whitening of polyacrylonitrile (PAN) fibres with shade variations.

Accordingly, the invention further relates to an aqueous dispersion containing (a) a fluorescent whitening agent, (b) a dispersing agent, (c) a β-1,3-glucane and (d) a vat dye.

FWAs which can be applied to PAN fibres are known to the person skilled in the art. Suitable brighteners are, for example, benzimidazole derivatives like C.I. Fluorescent Brightener 363.

Vat dyes suitable for dyeing of PAN are likewise well-known in the art. Examples are C.I. Vat Violet 1 and C.I. Vat Blue 66.

The invention further relates to a process for brightening textile materials by treatment with an aqueous dispersion containing components (a)+(b)+(c) or an aqueous dispersion containing components (a)+(b)+(c)+(d) as defined above.

The invention further relates to the use of an aqueous dispersion containing components (a)+(b)+(c) or an aqueous dispersion containing components (a)+(b)+(c)+(d) as defined above for brightening synthetic fibres.

The following Examples serve to illustrate the invention; parts and percentages are by weight, unless otherwise stated.

EXAMPLE 1

100 g bisbenzoxazole of formula (2b), 10 g of PPG 1750/80 EO (ethoxylated polypropylene glycol, 80 ethylene oxide units), 12.5 g of 1,2-propylene glycol and 0.25 g of glutaraldehyde are added to 127.25 g of deionised water. In a grinding beaker which can be cooled by water the dispersion is mixed with 500 g of glass beads (1 mm Ø) and milled 9 h under cooling by a conventional stirring device (700 rpm). After filtration 250 g of a ground stock containing 40% by weight of FWA is obtained.

90.71 g of deionised water, 138 g of a 1.5% aqueous solution of crude glucan (scleroglucan) and 1.29 g of Acticide® MBS (biocide containing 2.5% by weight of 2-methyl-2H-isothiazol-3-one and 2.5% by weight of 1,2-benzisothiazol-3(2H)-one) are mixed in a vessel. 230 g of the ground stock containing FWA is added and the mixture is stirred for 30 min (600 rpm) and homogenized. A clear dispersion containing 20% by weight of FWA is obtained. Samples of the dispersion are analysed with respect to storage stability; the results are summarized in Table 1.

COMPARATIVE EXAMPLE 2

100 g bisbenzoxazole of formula (2b), 10 g of PPG 1750/80 EO (ethoxylated polypropylene glycol, 80 ethylene oxide units), 12.5 g of 1,2-propylene glycol and 0.25 g of glutaraldehyde are added to 127.25 g of deionised water. In a grinding beaker which can be cooled by water the dispersion is mixed with 500 g of glass beads (1 mm Ø) and milled 9 h under cooling by a conventional stirring device (700 rpm). After filtration 250 g of a ground stock containing 40% by weight of FWA is obtained.

90.71 g of deionised water, 138 g of a 10% aqueous solution of polyvinylalcohol (Gohsenol® KH 17, supplied by Nippon Gohsei) and 1.29 g of Acticide® MBS (biocide containing 2.5% by weight of 2-methyl-2H-isothiazol-3-one and 2.5% by weight of 1,2-benzisothiazol-3(2H)-one) are mixed in a vessel. 230 g of the ground stock containing FWA is added and the mixture is stirred for 30 min (600 rpm) and homogenized. A clear dispersion containing 20% by weight of FWA is obtained. Samples of the dispersion are analysed with respect to storage stability; the results are summarized in Table 1.

TABLE 1

| Storage Stability | | |
|---|---|---|
| | Example 1 | Comparative Example 2 |
| 1 week RT | liquid, pH 8.2, no precipitate | liquid, pH 7.0, no precipitate |
| 1 month RT | liquid, pH 8.0, no precipitate | liquid, pH 6.7, trace of precipitate |
| 3 months RT | liquid, pH 7.7, no precipitate | liquid, pH 6.3, soft precipitate, turbid liquid |
| 6 months RT | liquid, pH 7.8, no precipitate | liquid, pH 6.2, soft precipitate, turbid liquid |
| 1 week 40° C. | liquid, pH 8.1, no precipitate | liquid, pH 6.6, no precipitate |
| 1 month 40° C. | liquid, pH 7.7, no precipitate | liquid, pH 6.6, soft precipitate, turbid liquid |
| 3 months 40° C. | liquid, pH 7.4, no precipitate | liquid, pH 5.7, soft precipitate, turbid liquid |
| 1 week 60° C. | liquid, pH 7.5, no precipitate | liquid, pH 5.5, soft precipitate, turbid liquid |

APPLICATION EXAMPLE 1 a) Application on Polyester in Exhaust Process

A polyester fabric (prescoured, heat-set at 195° C., 165 g/m$^2$) is treated, in a dyeing apparatus, at room temperature and at a liquor ratio of 1:20, with an aqueous bath containing a FWA according to Example 1 or Comparative Example 2, respectively. The temperature is raised from room temperature to 130° C. over 30 minutes, held for a further 30 minutes at this temperature and subsequently cooled to 40° C. during 15 minutes. The textile material is then rinsed for 30 seconds under running water and dried at 70° C. The samples are analysed with respect to degree of whiteness according to Ganz, tint value TV according to Ganz-Griesser and developing profile. The results are summarised in Tables 2a, 2b and 2c.

TABLE 2a

| Whiteness according to Ganz | | | | |
|---|---|---|---|---|
| Concentration of FWA | 0.02% | 0.04% | 0.08% | 0.16% |
| Dispersion of Example 1 | 170 | 187 | 202 | 209 |
| Dispersion of Comparative Example 2 | 168 | 185 | 201 | 208 |

TABLE 2b

| Tint Value according to Ganz-Griesser | | | | |
|---|---|---|---|---|
| Concentration of FWA | 0.02% | 0.04% | 0.08% | 0.16% |
| Dispersion of Example 1 | 0.0 | 0.1 | 0.4 | 1.0 |
| Dispersion of Comparative Example 2 | −0.1 | 0.1 | 0.3 | 0.8 |

TABLE 2c

| Developing profile, (0.16 % FWA)—Whiteness according to Ganz | | | | |
|---|---|---|---|---|
| Temperature | 100° C. | 110° C. | 120° C. | 130° C. |
| Dispersion of Example 1 | 187 | 209 | 211 | 211 |
| Dispersion of Comparative Example 2 | 185 | 208 | 210 | 210 |

b) Application on Polyester in Pad-Bake Process

A polyester fabric (prescoured, heat-set at 195° C., 165 g/m$^2$) is treated at room temperature by the pad-bake process with an aqueous liquor containing a FWA according to Example 1 or 2, respectively, in the ratios given in Tables 2a and 2b, in dispersed form and in the presence of 1 g/l of an alkali salt of a sulfonated dicarboxylic acid alkyl ester. The liquor pick-up is 50%. Subsequently, the fabric sample is dried for 30 minutes at 70° C. and then thermofixed during 30 seconds at 185° C. The samples are analysed with respect to degree of whiteness according to Ganz, tint value TV according to Ganz-Griesser and developing profile. While approximately the same results are obtained for both samples with respect to whiteness and tint value, the developing profile of the dispersion according to the invention is distinctly better. The results are summarised in Tables 3a, 3b and 3c.

TABLE 3a

| Whiteness according to Ganz | | | | |
|---|---|---|---|---|
| Concentration of FWA [g/l] | 0.4 | 0.8 | 1.6 | 3.2 |
| Dispersion of Example 1 | 168 | 185 | 201 | 207 |
| Dispersion of Comparative Example 2 | 167 | 184 | 200 | 207 |

TABLE 3b

| Tint Value according to Ganz-Griesser | | | | |
|---|---|---|---|---|
| Concentration of FWA [g/l] | 0.4 | 0.8 | 1.6 | 3.2 |
| Dispersion of Example 1 | −0.1 | 0.1 | 0.4 | 1.2 |
| Dispersion of Comparative Example 2 | −0.1 | 0.0 | 0.3 | 0.9 |

TABLE 3c

| Developing profile, (2.4 g/l FWA)—Whiteness according to Ganz | | | | | |
|---|---|---|---|---|---|
| Temperature | 160° C. | 170° C. | 180° C. | 190° C. | 200° C. |
| Dispersion of Example 1 | 190 | 203 | 206 | 207 | 205 |
| Dispersion of Comparative Example 2 | 190 | 201 | 203 | 204 | 203 |

EXAMPLE 3

A. Preparation of Ground Stock 11.0 g propylene glycol, 11.0 g Pluronic® F 108 (polypropylene glycol) and 0.22 g of a 50% aqueous solution of glutaraldehyde are dissolved in 43.78 g water at room temperature. 6.6 g of compound of formula (1a), 8.8 g of compound of formula (2a) and 28.6 g of compound of formula (2b) are added in portions. The slurry is stirred at room temperature for 30 minutes. In a grinding beaker which can be cooled by water the dispersion is mixed with 220 g of glass beads (1 mm Ø) and milled 1 h under cooling by a conventional stirring device (2200 rpm). After filtration 200 g of a ground stock containing 40% by weight of FWA is obtained.

B. Preparation of a Glucan Solution 2.0 g of crude glucan (scleroglucan), 4.0 g of 1,2-propylene glycol and 0.4 g of Acticide® MBS are added under stirring to 93.6 g of water at room temperature. The mixture is heated to 80° C. and stirred until a clear solution is obtained.

C. Preparation of the Final Dispersion 75 g of ground stock prepared under step A, 67.5 g of glucan solution prepared under step B, 0.93 g of Acticide® MBS and 156.67 g of water are mixed and the dispersion is stirred for 30 min at RT. Samples of the final dispersion so obtained are analysed with respect to storage stability; the results are summarized in Table 4.

TABLE 4

| Storage Stability | |
|---|---|
| | Example 3 |
| 1 week RT | liquid, pH 8.9, no precipitate |
| 1 month RT | liquid, pH 8.4, no precipitate |
| 3 months RT | liquid, pH 8.0, no precipitate |
| 6 months RT | liquid, pH 7.8, no precipitate |
| 1 week 40° C. | liquid, pH 8.2, no precipitate |
| 1 month 40° C. | liquid, pH 7.7, no precipitate |
| 3 months 40° C. | liquid, pH 7.4, no precipitate |
| 1 week 60° C. | liquid, pH 7.4, no precipitate |

EXAMPLE 4

A solution of 560 g C.I. Fluorescent Brightener 363 (15% formulation) is mixed with 3.15 g of crude glucan in a beaker under vigorous stirring. Wet-milled dispersions of vat dyes containing various amounts of C.I. Violet 1 or C.I. Vat Blue 66 are mixed with deionised water and the FWA dispersion is added. The dispersions are then stirred for 30 min (500 rpm).

The dispersions so obtained are applied to PAN fibres in an exhaust process at 98° C. giving bright whitened shades

The invention claimed is:

1. An aqueous dispersion containing (a) a fluorescent whitening agent, (b) a dispersing agent and (c) a β-1,3-glucane.

2. An aqueous dispersion according to claim 1 containing as fluorescent whitening agent a compound of formula (1)

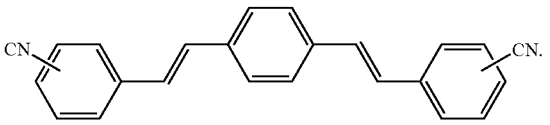

3. An aqueous dispersion according to claim 1 containing as fluorescent whitening agent a compound of formula (1a)

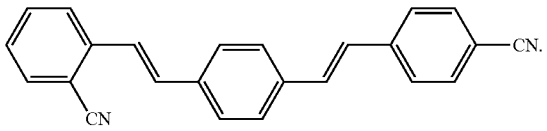

4. An aqueous dispersion according to claim 1 containing as fluorescent whitening agent a compound of formula (2)

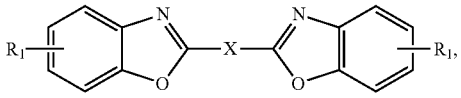

wherein $R_1$ denotes hydrogen, $C_1$-$C_6$ alkyl, $C_5$-$C_{14}$ aryl or $C_6$-$C_{24}$ aralkyl and X is a bivalent radical of formula (3), (4) or (5)

(3)

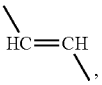

(4)

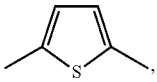

(5)

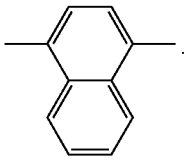

5. An aqueous dispersion according to claim 1 containing as fluorescent whitening agent a compound of formula (2a) or (2b)

(2a)

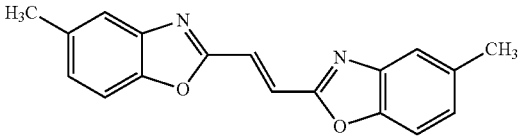

(2b)

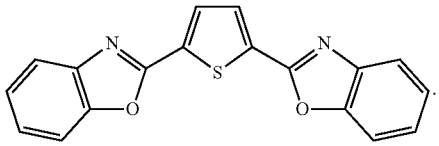

6. An aqueous dispersion according to claim 1 containing as dispersing agent a nonionic surfactant.

7. An aqueous dispersion according to claim 1 additionally containing ethylene glycol, propylene glycol, diethylene glycol, dipropylene glycol, polyethylene glycol or polypropylene glycol.

8. An aqueous dispersion according to claim 1 containing as β-1,3-glucane scleroglucan.

9. An aqueous dispersion according to claim 1 containing as fluorescent whitening agent a mixture comprising 5-25% by weight of a compound of formula (1)

(1)

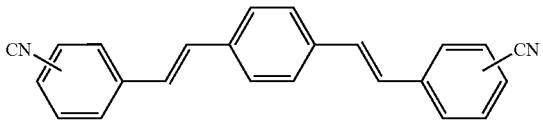

and 75-95% by weight of at least one compound of formula (2), (2)

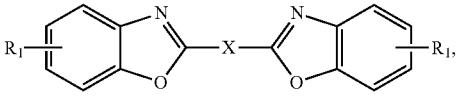

wherein $R_1$ denotes hydrogen, $C_1$-$C_6$ alkyl, $C_5$-$C_{14}$aryl or $C_6$-$C_{24}$ aralkyl and X is a bivalent radical of formula (3), (4) or (5)

(3)

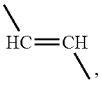

(4)

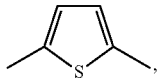

(5)

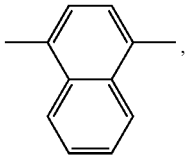

each percentage being based on the sum total of all fluorescent whitening agents.

10. An aqueous dispersion according to claim 9 containing as fluorescent whitening agent a mixture comprising 2.5 to 25% by weight of a compound of formula (1a)

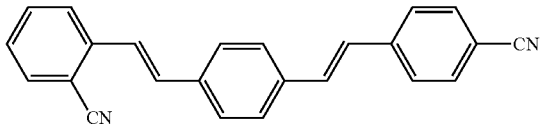

2.5 to 20% by weight of a compound of formula (2a)

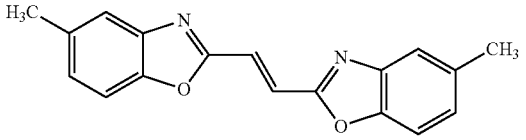

and 55 to 95% by weight of a compound of formula (2b)

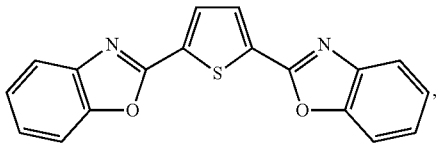

each percentage being based on the sum total of all whitening agents.

11. An aqueous dispersion according to claim 1 containing
(a) 5-40% by weight of a fluorescent whitening agent,
(b) 0.5-15% by weight of a dispersing agent and
(c) 0.5-10% by weight of a β-1,3-glucane, each percentage being based on the total weight of the dispersion.

12. An aqueous dispersion containing
(a) a fluorescent whitening agent,
(b) a dispersing agent,
(e) a β-1,3-glucane and
(d) a vat dye.

13. A process for brightening textile materials comprising treating the textile material with an aqueous dispersion according to claim 1.

14. A brightened textile material produced according to the process of claim 13.

15. A process for brightening textile materials comprising treating the textile material with an aqueous dispersion according to claim 12.

16. A brightened textile material produced according to the process of claim 15.

* * * * *